United States Patent [19]

Shmitka

[11] 4,349,825

[45] Sep. 14, 1982

[54] ANTENNA ASSEMBLY FOR HIGH FREQUENCY RANGES

[76] Inventor: Clarence F. Shmitka, 8554 Lurline Ave., Canoga Park, Calif. 91306

[21] Appl. No.: 160,086

[22] Filed: Jun. 16, 1980

[51] Int. Cl.[3] ..... H01Q 9/00

[52] U.S. Cl. ..... 343/750; 343/745

[58] Field of Search ..... 343/750, 873, 752, 895, 343/899, 745

[56] References Cited

U.S. PATENT DOCUMENTS

| | | | |
|---|---|---|---|
| 2,966,678 | 12/1960 | Harris | 343/895 |
| 3,400,403 | 9/1968 | Spilsbury | 343/750 |
| 3,798,654 | 3/1974 | Martino et al. | 343/750 |
| 4,080,604 | 3/1978 | Wosniewski | 343/750 |
| 4,097,867 | 6/1978 | Eroncig | 343/750 |

*Primary Examiner*—David K. Moore
*Attorney, Agent, or Firm*—John J. Posta, Jr.

[57] ABSTRACT

An antenna suitable for use in the high frequency (HF) ranges includes a resonator tunable over a predetermined frequency band. The resonator consists of an insulated wire wound over a dielectric rod. Tuning is effected by sliding a metallic sleeve disposed in frictional contact over the wire. A multiplicity of these resonator units may be mounted on a single collar at different angles. Each of the resonator units will respond to a particular frequency. The remaining devices operate as a load on the antenna assembly. The antenna assembly may also be mounted on a conventional mobile antenna by means of an adaptor unit.

15 Claims, 6 Drawing Figures

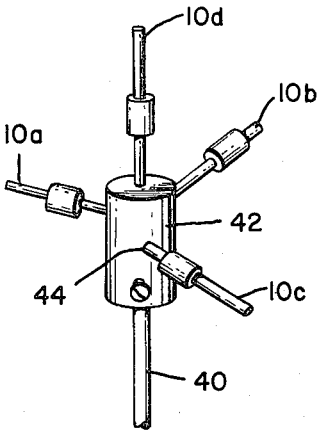
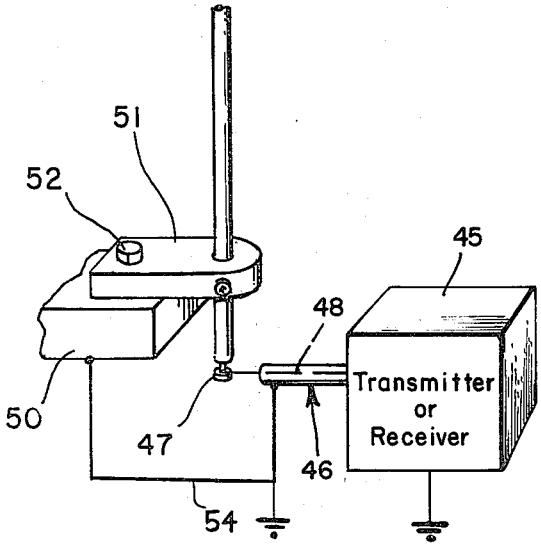
Fig. 4.
Fig. 5.
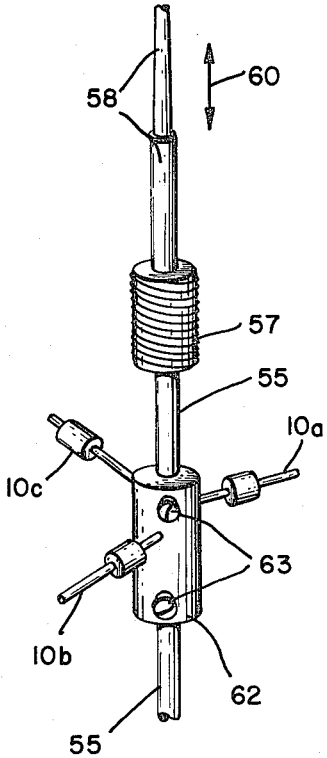

ANTENNA ASSEMBLY FOR HIGH FREQUENCY RANGES

BACKGROUND OF THE INVENTION

This invention relates generally to antennas and particularly to an antenna of the type tunable over the high frequency (HF) ranges, 3.5 to 30 MHz, such as are used with mobile or fixed radio stations.

Such antennas are well known in the art. They usually include a helically wound resonator mounted on a whip-type antenna. These antennas are frequently used with automobiles for either transmitting or receiving on an amateur frequency band. However, these conventional antennas cannot be utilized as multiband antennas. While the resonator of such antennas is tunable, it cannot be reset to a precise frequency without considerable guesswork.

The resonator of such prior art antennas is quite large in diameter and provides a substantial wind resistance. For this and other reasons, the antenna is usually spring-mounted at the base so that the entire structure can whip back and forth over the car body. This causes a varying distributed capacitance, which in turn will affect the tuning.

It is therefore an object of the present invention to provide a short and efficient antenna for the purpose discussed, which has a relatively small diameter and hence, less wind resistance.

Another object of the invention is to provide a logging scale between movable parts of the antenna to facilitate tuning of the resonator to a particular frequency.

A further object of the present invention is to provide an antenna assembly which is capable of responding to a plurality of frequency bands.

SUMMARY OF THE INVENTION

In accordance with the present invention, there is provided an antenna or antenna assembly suitable for either mobile or fixed stations, and for either receiving or transmitting within certain radio frequency bands such as, but not limited to, the amateur radio bands. The antenna basically consists of a mast bearing several dielectric rods at its upper end upon which an insulated wire is helically wound. These rods are known as resonators. A plurality of these resonators may be mounted on one collar at different angles. This collar in turn is affixed to the upper end of the mast. In this manner, each resonator may be tunable over a particular frequency band, such as for example, the 10-meter, 15-meter, 20-meter, and 40-meter amateur bands. Tuning is effected by a metallic sleeve slidably arranged over the wire. To provide good frictional engagement, a plastic tube is shrunk over the wire. Another plastic tube is shrunk over the sleeve and extends beyond the ends of the sleeve in close contact with the helically wound wire and its tube. This will provide a frictional contact so that the sleeve will not readily move from its desired position, and yet allows tuning of the resonator. The resonator may be terminated by a short rod made of aluminum or other suitable metal which minimizes corona discharge.

It is also feasible to provide an adaptor, again in the form of a collar, which may be mounted on the mast of a conventional mono-band antenna, thereby providing a plurality of separate ranges.

The novel features that are considered characteristic of this invention are set forth with particularity in the appended claims. The invention itself, however, both as to its organization and method of operation, as well as additional objectives and advantages thereof, will best be understood from the following description when read in connection with the accompanying drawings.

BRIEF DESCRIPTION OF THE DRAWINGS

FIG. 3(*a*) is a cross-sectional view taken along lines 3*a*–3*a* of FIG. 3;

FIG. 4 is a view in perspective of a multiband antenna in accordance with the present invention and connected by a coaxial cable to a transmitter or receiver; and FIG. 5 is a view in perspective similar to that of FIG. 4, but illustrating an adaptor with several tunable resonators which may be used in connection with a conventional whip antenna.

DETAILED DESCRIPTION OF THE PREFERRED EMBODIMENT

Figure 1:
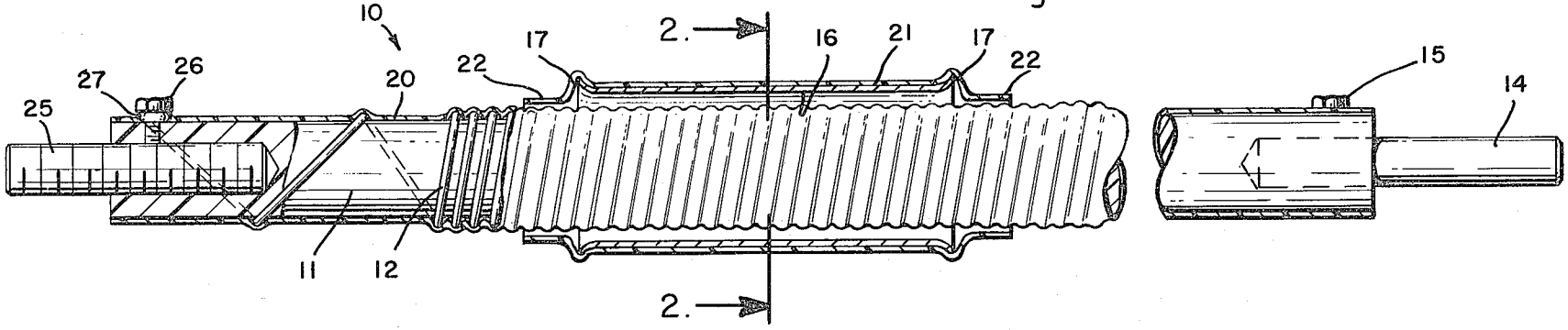
FIG. 1 is a side elevational view, partly in section, of a resonator forming part of the antenna of the invention.
Figure 2:
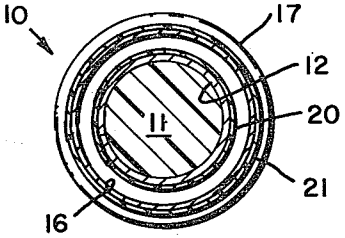
FIG. 2 is a cross-sectional view taken on lines 2—2 of FIG. 1 of the resonator.

Referring now to the drawings and particularly to FIG. 1, there is illustrated a tunable resonator 10 embodying the present invention. This tunable resonator forms part of an antenna assembly of the type illustrated in FIG. 4. The resonator 10 includes a rod 11 which consists of a dielectric material such as, for example, fiberglass. It should be noted that the rod 11 may be hollow, to reduce the weight of the resulting antenna. An insulated wire 12, such as a copper wire, insulated, for example, by enamel, is helically wound over the rod 11. The wire 12 may, for example, consist of No. 20 AWG enamelled copper wire.

A rod 14 made of aluminum or other suitable metal is secured to the rod 11, for example, by a screw 15 extending into and contacting the rod 14. Wire 12 is attached to screw 15. The purpose of rod 14 is to minimize corona effects.

A hollow metallic tuning sleeve 16 is disposed above wire 12. The tuning sleeve 16 may consist of any ferrous or non-ferrous metal or metal alloy.

An opaque plastic tube 20 is shrunk over the wire 12 and rod 11 to provide weather-proofing and smooth surface. Similarly, a plastic tube 21 is shrunk over the sleeve 16. The tube 21 has end portions 22 which extend beyond the sleeve 16. These plastic end portions 22 are in frictional contact with the tube 20.

This may, for example, be accomplished by providing a mandrel having an outer diameter which is no less than the outer diameter of the shrink tube 20. The metallic sleeve 16 is then pushed over the mandrel and thereafter the shrink tube 21 is applied. This will ensure a frictional contact between the shrink tube 20 of the rod 11 and the outer ends 22 of the tuning sleeve shrink tube.

A metallic stud 25 may be secured to the other end of the rod 11, for example by a screw 26 or the like. The wire 12 may be secured to the screw 26 as shown at 27 to provide an electrical connection to the resonator.

Figure 3A:
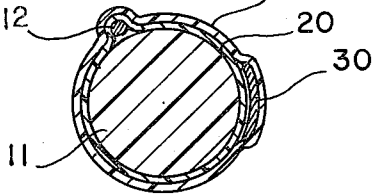
FIG. 3 is a front elevational view of the device shown in FIG. 1, also showing the logging scale.
Figure 3:
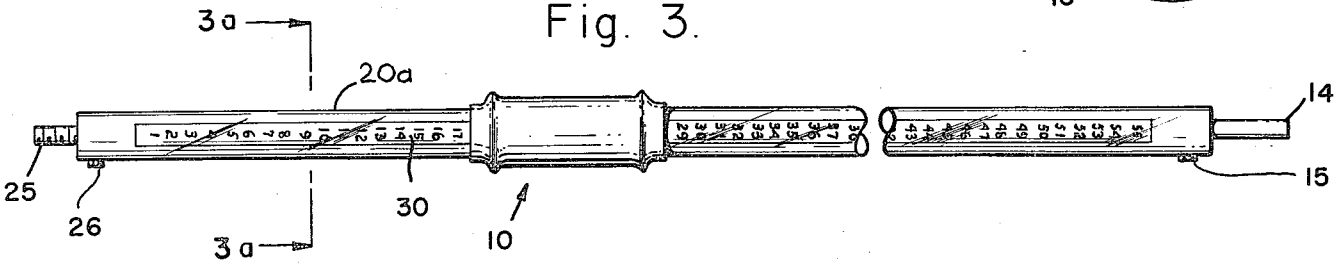

As shown in FIG. 3, a logging scale 30 may be provided which is also shown in FIG. 3. The logging scale 30 is preferably disposed over plastic tube 20 over which a plastic transparent tube 20(*a*) is shrunk which serves to hold and protect logging scale 30. The logging scale 30 may consist of a strip of flexible material such as paper, on which numerals 31 are provided. The logging scale 30 extends along the length of the rod 11. It serves the purpose to provide reproducible frequency settings. In other words, the logging scale makes it possible to reset the tuning sleeve 16 to a previously found value corresponding to a desired frequency.

In operation, the resonator of FIG. 1 may be mounted on a suitable mast by its metallic stud 25 as by collar 42, FIG. 4. Tuning is effected by sliding the sleeve 16 back and forth over the resonator, or inductor. As the sleeve moves toward the collar, or inner end of the resonator, a higher frequency is obtained, and vice versa. The mast may be made of a rod or tube of aluminum or other suitable metal.

It should be noted that the entire antenna may have a length of 4 to 6 feet. This is much shorter than conventional whip antennas. Also, the diameter of the resonator 10 may be made much smaller than in conventional whip antennas.

By sliding the tuning sleeve along the resonator its inductance is varied, thereby changing its resonant frequency. This in turn tunes the voltage standing wave ratio (VSWR) out at the resonant frequency.

Referring now to FIG. 4, there is illustrated a multiband antenna unit in accordance with the present invention. The antenna of FIG. 4 includes a mast 40 which may be mounted to an auto body 50 by any suitable bracket made out of insulating material, such as bracket 51, or any other readily available commercial mounting means. Bracket 50 can be secured to the auto body by bolt 52.

The multiband antenna includes a collar 42 secured to the mast 40 in a suitable manner. Mounted on the collar 42 are a plurality of resonator units such as 10*a*, 10*b*, 10*c*, and 10*d*, each of which may correspond to the resonator of FIG. 1. However, each of the units 10*a* through 10*d* is tuned to a different frequency band, such as the 10, 15, 20, and 40-meter amateur radio bands which are in the HF portion of the radio frequency spectrum.

The units 10*a* through 10*c* may, for example, be mounted in suitable openings 44 in the collar 42. Preferably, each of the units 10*a* through 10*c* forms an acute angle with the mast 40; that is, an angle other than 90 degrees, in order that it may be on the axis of the mast 40. The antenna may now be connected to either a transmitter or receiver 45, because it is well known that any antenna can be used for either radiating or receiving electromagnetic waves. The transmitter or receiver 45 is connected to the antenna by a coaxial cable 46 having its center wire connected to the base of the antenna at 47 and its shield connected to the frame of the vehicle, which is at ground potential, via connection 54, with the coaxial cable having a 50 ohm characteristic impedance.

It should be noted that the multi-antenna structure of FIG. 4 provides automatic selection of the desired resonator. In other words, one of the various resonators is tuned to a particular frequency which is either transmitted or received. It is the only one which resonates to that particular frequency. However, the other untuned resonator units, 10*a* through 10*d*, help to top-load the antenna. The adjustment of the tuning of any one resonator does not affect the tuning of any of the remaining resonators.

It should be noted that in the antenna structure of FIG. 4 the high current is at the top. Therefore, any metallic mass near the bottom of the rod does not much affect tuning. Nevertheless, it is recommended that the antenna structure of the invention be rigidly mounted on a car. Alternatively, it may also be used with a fixed station.

It should further be noted that the tuning sleeve 16 should be shorter for the higher frequency bands and longer for the low frequency bands. The reason for the different lengths of the tuning sleeve 16 is that the Q of the resonant circuit of a larger bandwidth provides a better match to the transmitter. Also, the VSWR is at a very low minimum.

It will also be understood that each one of the resonator units 10*a* through 10*d* may be pre-tuned to a particular frequency. It is also feasible to provide an adaptor unit which enables use of the multiband antenna of the invention with a conventional whip-type antenna. This is illustrated in FIG. 5, to which reference is now made. As shown in FIG. 5, there is provided a mast 55 which carries a conventional resonator 57. The resonator 57 is tuned by pushing a tuning rod 58 into or out of the resonator 57. The rod 58 telescopes in a conventional manner and is moved as shown by the double arrow 60.

Below the resonator structure 57 there is mounted an adaptor 62 which may be secured to the mast 55 by set screws 63. The adaptor 62 serves the function of the collar 42 and may, again, be provided with a plurality of resonator units such as 10*a*, 10*b*, 10*c*, each being tunable over a predetermined frequency range.

There has thus been disclosed a multiband antenna which may readily be tuned in a reproducible manner. By means of an adaptor unit the multiband antenna of the invention may be used with a conventional whip antenna. The resonator of the invention is tuned by a metallic sleeve which is in frictional contact with the inductor of the unit. A logging scale may be provided over the inductor to provide reproducible tuning.

By varying (increasing or decreasing) the dimensions and specifications of the various components of this antenna assembly it may be adapted for use at a fixed station.

What is claimed is:

1. A multi-band antenna assembly being capable of being tuned separately for each of a plurality of different predetermined frequency ranges and comprising in combination:

a. a conventional single band tunable antenna including a mast, a conventional resonator fixedly mounted on said mast and a rod capable of telescoping into and out of said conventional resonator;

b. a multi-band adaptor including:

c. a collar capable of being slidable over said mast and being fixed to said mast;

d. a plurality of dielectric rods, each having a length corresponding to a predetermined frequency range;

e. an insulated wire wound helically about each of said rods to form a coil;

f. a tuning sleeve capable of sliding over each of said helically wound wires; and g. a plurality of openings in said collar for receiving each one of said rods to form an acute angle between each of said rods and said mast.

2. An antenna assembly as defined in claim 1 wherein a first plastic shrink tube extends over each of said wires, and a second plastic shrink tube extending over each of said sleeves.

3. An antenna assembly as defined in claim 2 wherein a metallic stud is provided and means for securing said stud to one end of each of said rods.

4. An adaptor unit for converting a conventional single band mobile antenna for use with multiple bands, the single band antenna being of the type having a conventional electric resonator mounted on a metallic mast, and a rod capable of telescoping into and out of the conventional resonator, said adaptor unit comprising:

a. a metallic collar capable of being secured to the mast below the conventional resonator, said collar having a plurality of openings for receiving a plurality of devices, each being tunable over a different predetermined frequency range each of said devices forming an acute angle with the mast; and b. each of said devices including an inductor and a tuning sleeve capable of sliding over said inductor to vary the resonant frequency thereof said sleeve having a floating electric potential.

5. An adaptor as defined in claim 4 wherein each device has a length different from that of the other devices and corresponding to a desired frequency range.

6. An electric resonator capable of being tuned over a predetermined frequency range, comprising:

a. a dielectric rod;

b. an insulated wire helically wound over said rod to form a coil;

c. a cylindrical metallic sleeve slidable over said rod and wire for varying the resonant frequency of said resonator, said sleeve having a floating electric potential; and d. a first plastic shrink tube directly disposed over said wire on said rod.

7. A resonator as defined in claim 6 wherein a second plastic shrink tube is directly disposed over said sleeve said second shrink tube extending over said sleeve and beyond the ends of said sleeve to provide frictional contact with said first shrink tube.

8. A resonator as defined in claim 6 wherein said rod is a hollow rod.

9. A resonator as defined in claim 6 wherein a metallic stud is provided, and means for securing said stud to one end of said rod.

10. A resonator as defined in claim 9 wherein a metallic member is provided and means for attaching said metallic member to the other end of said rod thereby to minimize corona effects.

11. A resonator as defined in claim 7 wherein said sleeve and said first tube on said rod are spaced apart.

12. An electric resonator capable of being tuned over a predetermined frequency range comprising:

a. a dielectric rod;

b. an insulated wire helically wound over said rod to form a coil;

c. a cylindrical metallic sleeve slidable over said rod and wire for varying the resonant frequency of said resonator, said sleeve having a floating electric potential;

d. a scale disposed between said wire and said sleeve to permit sliding of said sleeve back again to a previously found position corresponding to a desired frequency; and e. a first plastic shrink tube extending over said wire.

13. A resonator as defined in claim 12 wherein a transparent plastic shrink tube extends over said first plastic shrink tube said scale consisting of a strip of flexible material having numerals thereon and said strip being disposed between said first shrink tube and said transparent shrink tube.

14. A resonator as defined in claim 12 wherein a second plastic shrink tube extends over said sleeve said second shrink tube extending over said sleeve and beyond the ends of said sleeve to provide frictional contact with said first shrink tube.

15. An antenna assembly as defined in claim 3 wherein a metallic member is provided and means for attaching said metallic member to the other end of each of said rods, thereby to minimize corona effects.

* * * * *